US007331461B2

(12) United States Patent
MacKinnon

(10) Patent No.: US 7,331,461 B2
(45) Date of Patent: Feb. 19, 2008

(54) SYSTEMS FOR ORGANIZING AND CARRYING FOOD PREPARATION ITEMS

(76) Inventor: Mary Ann MacKinnon, 4418 SW. 54th Pl., Portland, OR (US) 97221

( * ) Notice: Subject to any disclaimer, the term of this patent is extended or adjusted under 35 U.S.C. 154(b) by 0 days.

(21) Appl. No.: 11/200,253

(22) Filed: Aug. 8, 2005

(65) Prior Publication Data

US 2006/0108240 A1 May 25, 2006

Related U.S. Application Data

(63) Continuation-in-part of application No. 10/192,837, filed on Jul. 9, 2002, now abandoned.

(51) Int. Cl.
*B65D 1/34* (2006.01)

(52) U.S. Cl. ..... 206/553; 206/473

(58) Field of Classification Search ..... 206/37, 206/223, 349, 553, 472, 473, 372, 373, 541, 206/576; 150/113, 115, 130; 190/102, 109, 190/110, 111, 127

See application file for complete search history.

(56) References Cited

U.S. PATENT DOCUMENTS

| | | | | |
|---|---|---|---|---|
| 2,646,833 | A * | 7/1953 | Meyers | 150/130 |
| 4,852,293 | A * | 8/1989 | Levine et al. | 190/110 |
| 5,829,502 | A * | 11/1998 | Distefano et al. | 150/113 |
| 5,897,209 | A * | 4/1999 | Roegner | 150/113 |
| 6,626,601 | B1 * | 9/2003 | Moor et al. | 206/472 |
| 6,715,594 | B2 * | 4/2004 | Milionta et al. | 190/110 |
| 6,910,580 | B1 * | 6/2005 | Frankum | 206/553 |
| 7,165,673 | B2 * | 1/2007 | Marks | 206/473 |

* cited by examiner

*Primary Examiner*—Luan K Bui
(74) *Attorney, Agent, or Firm*—Kolisch Hartwell, P.C.

(57) ABSTRACT

Food preparation kits and organizing systems include a case for containing combinations of spices and/or utensils and cooking accessories. A case may take the form of a book including front and back covers connected by a spine portion. Spices may be organized and retained inside the case along with utensils such as knives, tongs and measuring spoons.

14 Claims, 6 Drawing Sheets

Fig. 9
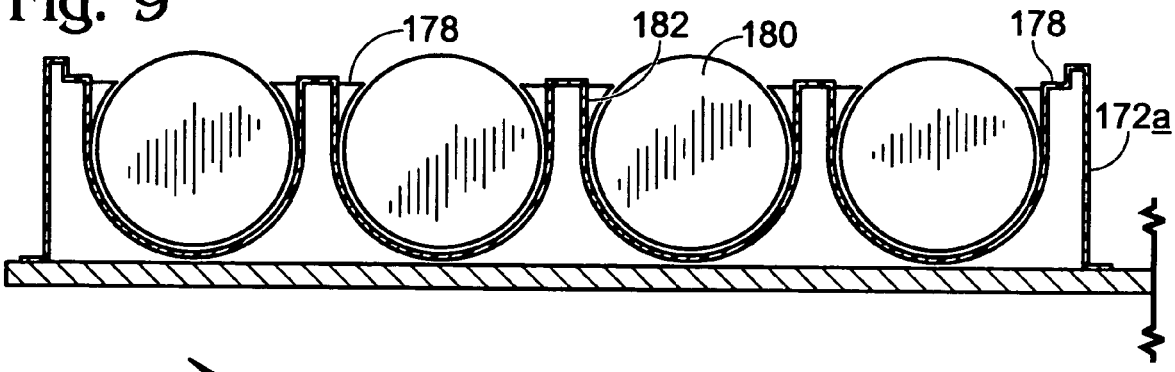
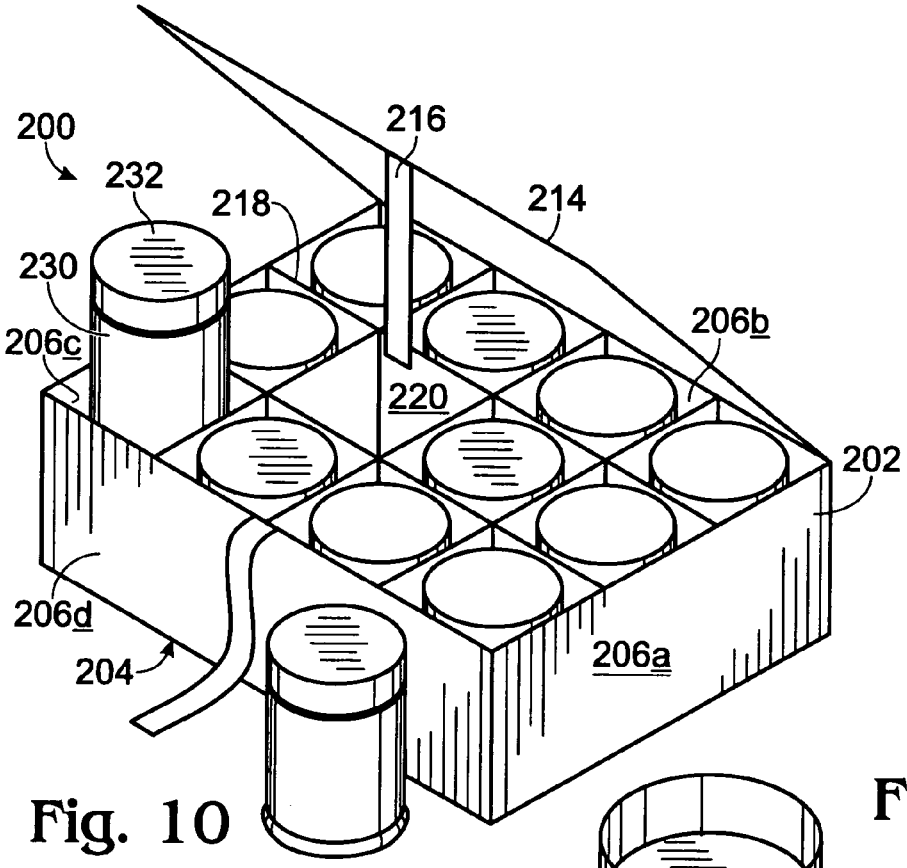
Fig. 10
Fig. 11
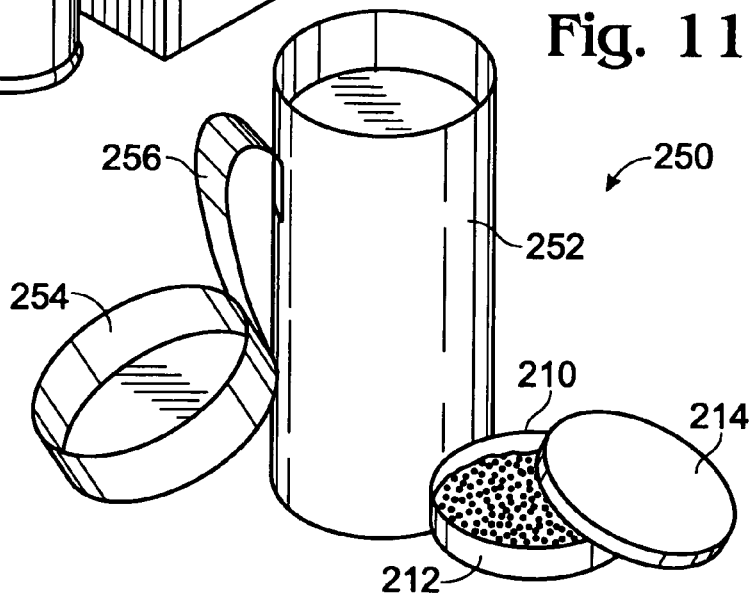

SYSTEMS FOR ORGANIZING AND CARRYING FOOD PREPARATION ITEMS

CROSS-REFERENCE TO RELATED APPLICATION

This application is a continuation-in-part of and claims priority to U.S. patent application Ser. No. 10/192,837, which was filed on Jul. 9, 2002, entitled "Systems for Organizing and Carrying Food Preparation Items," now abandoned, and the disclosure of which is incorporated herein by reference.

FIELD

The invention relates to portable spices and kitchenware. In particular, the invention provides kit configurations and systems that can be customized for carrying combinations of spices and assorted kitchen items.

BACKGROUND

People who travel often desire to use someone else's kitchen which may not be equipped with an adequate or desirable selection of spices and/or other kitchen accessories. For example, "equipped kitchens" in rental properties typically have little or no spices other than salt and pepper. A single dull knife is typically provided and inadequate for the desired task.

Some people may pack cooking items loosely in a bag or suitcase. However, this approach is unsatisfactory because the food preparation items are not sufficiently organized, and are therefore difficult to use. Similarly, when hiking or camping, it is typically difficult to assemble the ideal spice and kitchen accessory combination for the particular trip in an organized container that is lightweight, easy, and efficient to use.

Accordingly, it may be desirable to provide portable kit configurations for carrying customized combinations of spices and/or accessories for cooking and preparing food while traveling.

SUMMARY

Portable kitchen kit assemblies and configurations may be customized for a particular trip to include an assortment of spices as well as cooking utensils and printed recipe materials. For example, a book-shaped case has first and second panel portions hinged together along a spine portion so that the panel portions can be folded together to close the case, and alternately opened to access the interior of the case.

BRIEF DESCRIPTION OF THE FIGURES

FIG. 9 is a cross-sectional view through the case shown in FIG. 8.

FIGS. 10 and 11 show alternative case designs for carrying spices.

DETAILED DESCRIPTION AND BEST MODE

Figures 1, 2:
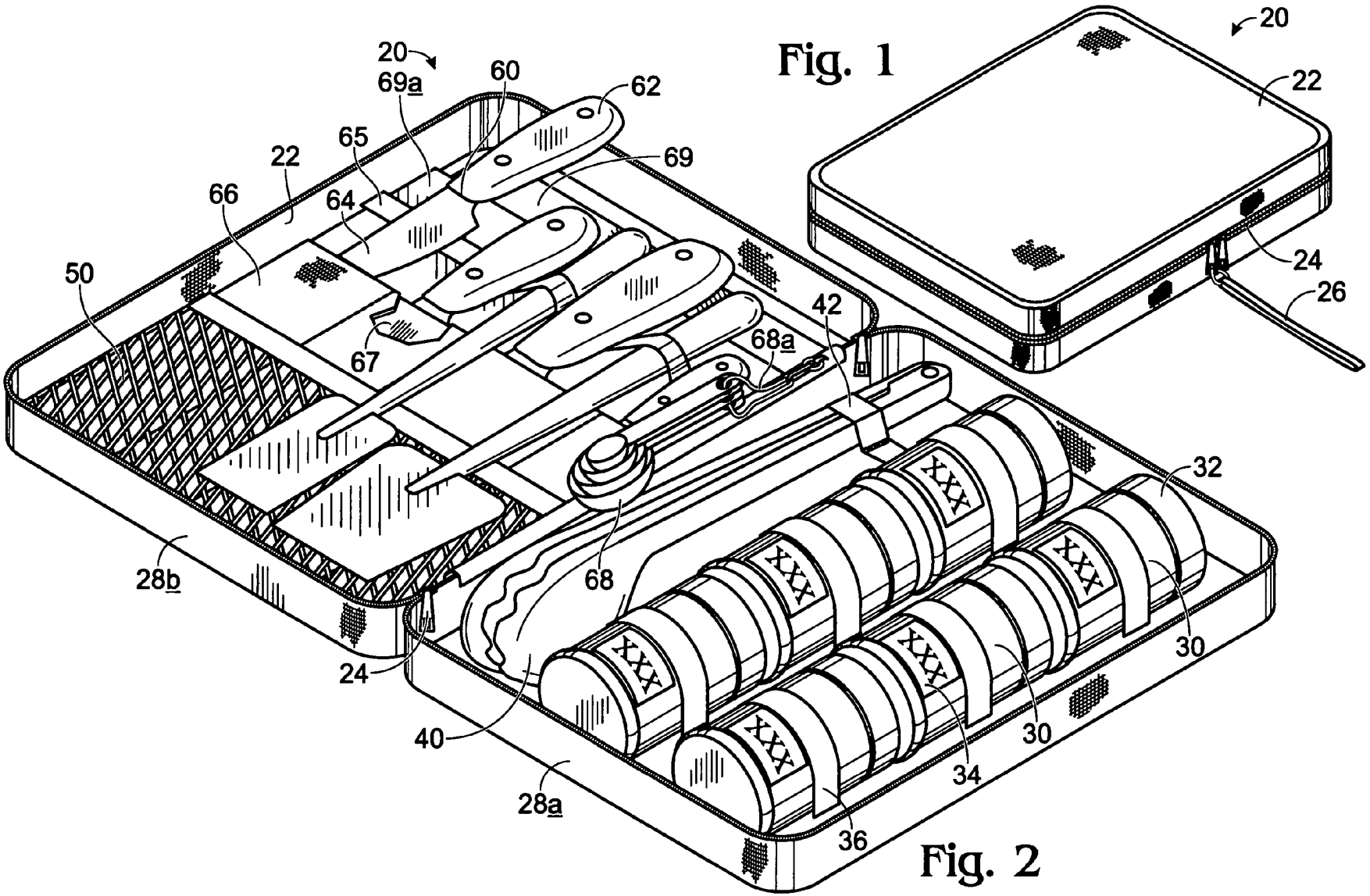
FIG. 1 is a perspective view of a portable kitchen kit.
FIG. 2 is a perspective view of the kit shown in FIG. 1, in an open configuration displaying the contents of the kit.

FIG. 1 shows portable kitchen kit 20 including flexible carrying case or housing 22. Carrying case 22 has two substantially similar or equal rectangular panel portions that are hingedly connected along a spine portion of the case so that the case can be opened in a book-like manner to access the contents of the case. Zipper fastening mechanism 24 is provided to maintain case 22 in a closed condition for storage or transport. Handle or loop member 26 may be provided on case 22, for example, connected to zipper 24.

FIG. 2 shows case 22 in an open configuration. Case 22 opens into two side panel portions or cupboard-like spaces, including first side panel portion 28*a* and second side panel portion 28*b*. As shown, numerous articles for cooking or preparing food, such as spice bottles, knives, tongs, a cutting surface, and recipe cards, may be contained in case 22. The term "spice" as used in this description may include traditional and/or common spices, exotic spices, herbs, and seasonings. Articles stored in case 22 are arranged in a logical fashion so that a user may determine at a glance which items are equipped or missing, and may access each item quickly and conveniently, without having to first disengage or remove adjacent items. Articles are arranged separately and securely, to prevent clutter caused by items dislodging during transit or storage. For example, sharp utensils are stored so that their edges are protected, to prevent puncturing or cutting other articles or the exterior of case 22, or to prevent dulling of the edges. Moreover, the arrangement of the items provides internal structure and stability to case 22 when it is closed.

In FIG. 2, first panel 28*a* holds a plurality of spice containers 30. Each container has a lid 32 and label 34, and may be secured by elastic restraint 36. Restraint 36 may accommodate a standard 2- or 4-oz. cylindrical spice container so that label 34 is not obscured. The elastic nature of the restraints will readily accommodate roughly similar containers of other sizes and shapes. Additionally, the elasticity of restraint 36 allows container 30 to be removed from its restraint without removing or affecting adjacent containers. Restraint 36 may optionally be used to hold items other than spices. Panel 28*a* may also hold a pair of tongs 40, or other kitchen utensil, with another elastic restraint 42. Other types of restraint devices may be used such as VELCRO straps, clips, snaps, etc. As used herein, a restraint or retention device holds an item against a panel even if the panel is held face down or moderately shaken or squeezed.

Second panel 28*b* has a mesh pocket 50 for holding recipe cards or other printed materials. Pocket 50 may hold other things such as seasoning packets or other small utensils. Pocket 50 may alternatively be an accordion-style envelope, a restraining strap, or similar means for storing and/or displaying printed matter. Second panel 28*b* also may contain one or more knives 60. Knife 60 includes handle 62 and blade 64. Elastic strap 65 may go behind some implements and in front of others as shown. Adjacent flat pockets 66 each provide a protective, separate sheath 67 for a knife blade. Alternatively, other bladed or flat utensils may be stored in flat pockets 66. A set of measuring spoons 68 is secured by clip 68*a*. Flexible cutting surface 69 may be stored in large, flat pocket 69*a*, positioned underneath knife pockets 66 and providing protection against knife blades 64 piercing the exterior wall of case 22. Knives 60 and cutting surface 69 also lend structural rigidity to case 22, which may be used as a substantially flat and sturdy work area when closed. Alternatively, cutting surface 69 may be placed on top of closed case 22 to provide a flat food preparation surface.

Figure 3:
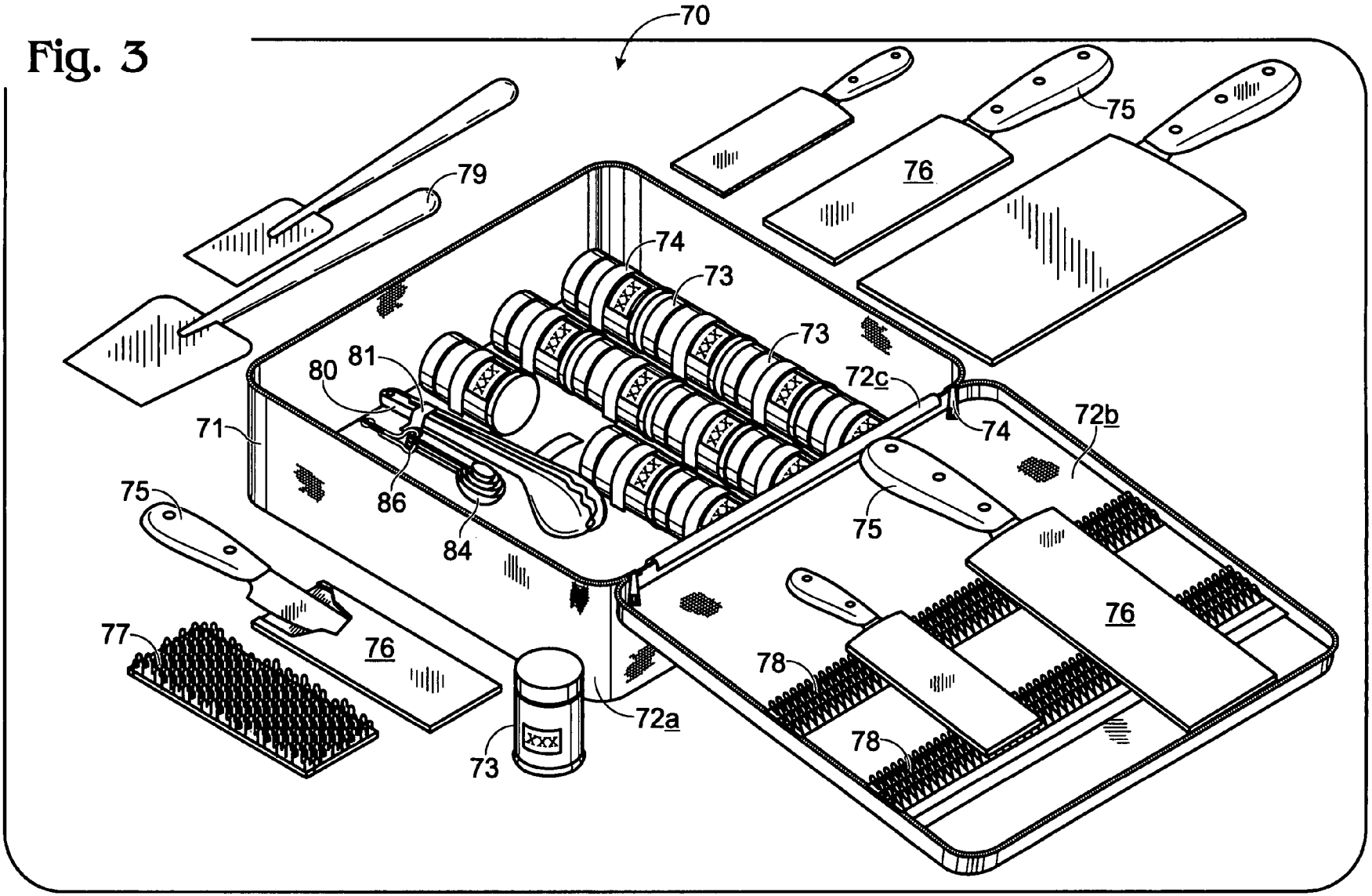
FIG. 3 is a perspective view of an alternative portable kitchen kit.

FIG. 3 shows a portable kitchen kit 70 which is similar to kit 20 in some respects. However, kit 70 is larger to accommodate more spices and/or cooking utensils or accessories. Case 71 includes deep panel portion 72*a* and top panel portion 72*b* which are hinged together along spine portion 72*c*. Spice containers 73 are held by elastic restraints 74 inside deep panel portion 72*a*. Knives 75 fit into removable sheath members 76. Each sheath member 76 is provided with hook-or-loop area 77 on at least one side of sheath member 76. Hook-or-loop area 77 on sheath member 76 may be fastened to hook-or-loop bands 78 provided on the inside of top panel portion 72*b*. This configuration allows significant flexibility to arrange different knife combinations or other utensils in case 71 for different trips or food preparation objectives. The arrangement in case 71 is also advantageous because the protective sheath for a given knife may stay with the knife away from the case. It also allows the knife or utensil holders to be more easily cleaned. Kit 70 in FIG. 3 is also shown including other utensils such as spatula 79. Tongs 80 or other utensils may be secured by elastic retainer 81. Measuring spoons 84 are held by clip 86.

Figures 4, 5:
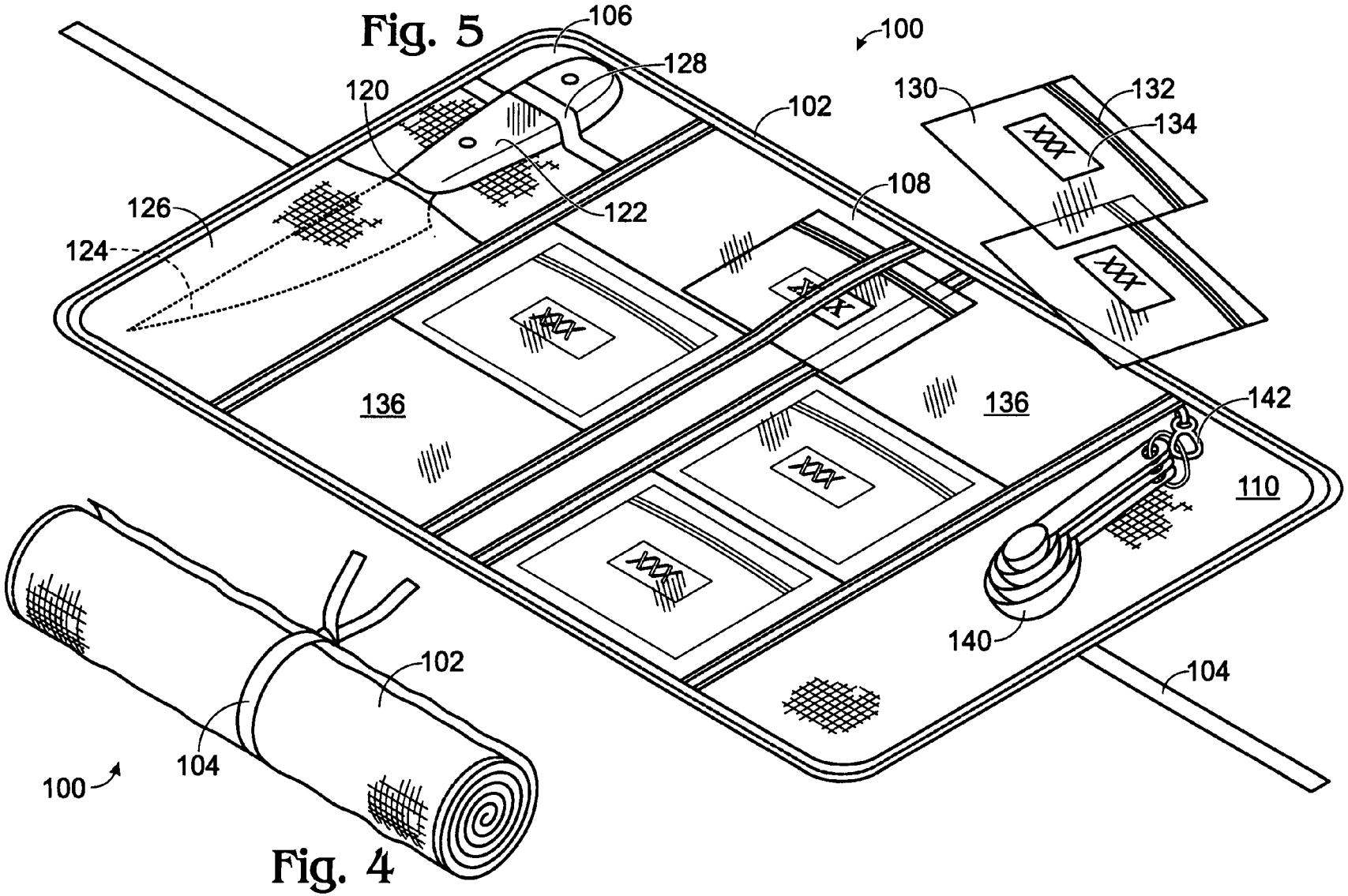
FIG. 4 is a perspective view of another portable kitchen kit rolled up for storage or transport.
FIG. 5 is a perspective view of the kit shown in FIG. 4, opened up to display its contents.

FIG. 4 shows another example of a portable kitchen kit 100. Kit 100 includes flexible carrying case or housing 102. Case 102 is a single rectangular panel that can be unrolled to access contents of the case. Strap fastening member 104 is provided to maintain case 102 in closed, rolled-up condition for storage or transport. Case 102 may also be provided with a zipper fastening mechanism along its periphery to allow folding and securing of the case for storage or transit.

FIG. 5 shows case 102 in an unrolled, open configuration. Numerous articles for cooking and/or preparing food may be contained in case 102 in a useable and functional presentation, displayed in a substantially flat arrangement. Case 102 consists of an elongate rectangular panel portion with three areas generally designated as first end 106, central area 108, and second end 110. Near first end 106, knife 120, including handle 122 and blade 124, is stored in flat pocket 126 and secured with elastic restraint 128. Flat compartments or pouches 130 are each provided with a closing device 132, for example, a zip lock mechanism, and label 134. Pouches 130 are preferably made of transparent material so a user may quickly determine the amount, or verify the identity, of the contents of each pouch. Central area 108 of case 102 has two parallel columns of adjacent, transparent pockets 136 for storage of pouches 130. Although two columns of three pockets each are shown, many different pocket arrays are possible. Each pocket 136 is transparent so that a user can see the contents of enclosed pouch 130 without having to remove it. Pocket 130 preferably has a transparent plastic front, or may have a mesh front. Each pocket 136 has a side opening directed toward the center of case 102. When case 102 rolls up for storage or transit, pockets 136 with side openings oriented in a direction perpendicular to the rolling axis prevent dislodging of the pouch during transit. In this embodiment, each row of pockets opens inwardly towards the center of the case for convenience, although the pockets could open in the same direction, or outwardly towards the side edges of case 102. Alternatively, each pocket 136 may be equipped with a flap closure or similar device, to further protect against dislodging of the stored pouch. Measuring spoons 140 are secured by clip 142. Other utensils may also be stored in flexible case 102.

Figure 6:
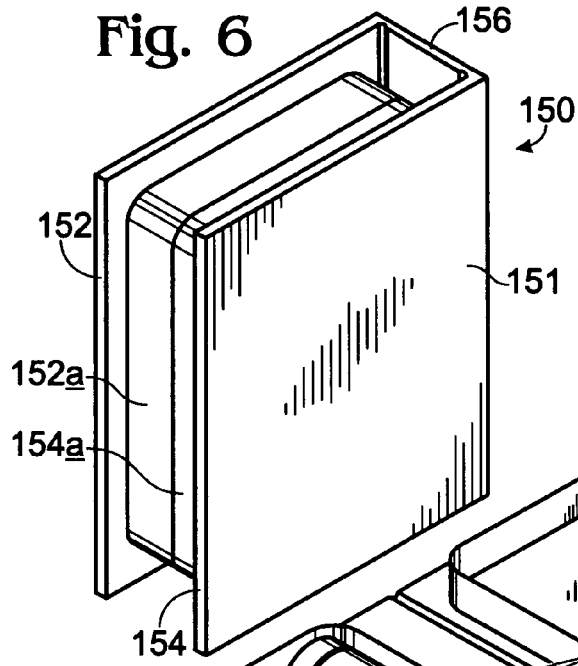
FIG. 6 is a perspective view of a book-shaped case for carrying a combination of spice containers.

FIG. 6 shows another food preparation kit 150 in the form of a book. Kit 150 includes case 151. Case 151 has front cover 152 hingedly connected to back cover 154 through spine portion 156. Formed walls 152*a* and 154*a* are provided on front cover 152 and back cover 154, respectively, for containing the contents of case 151 when it is closed. Covers 152 and 154 are sufficiently rigid so that case 151 can stand up on one end to minimize use of counter space or shelf space.

Figure 7:
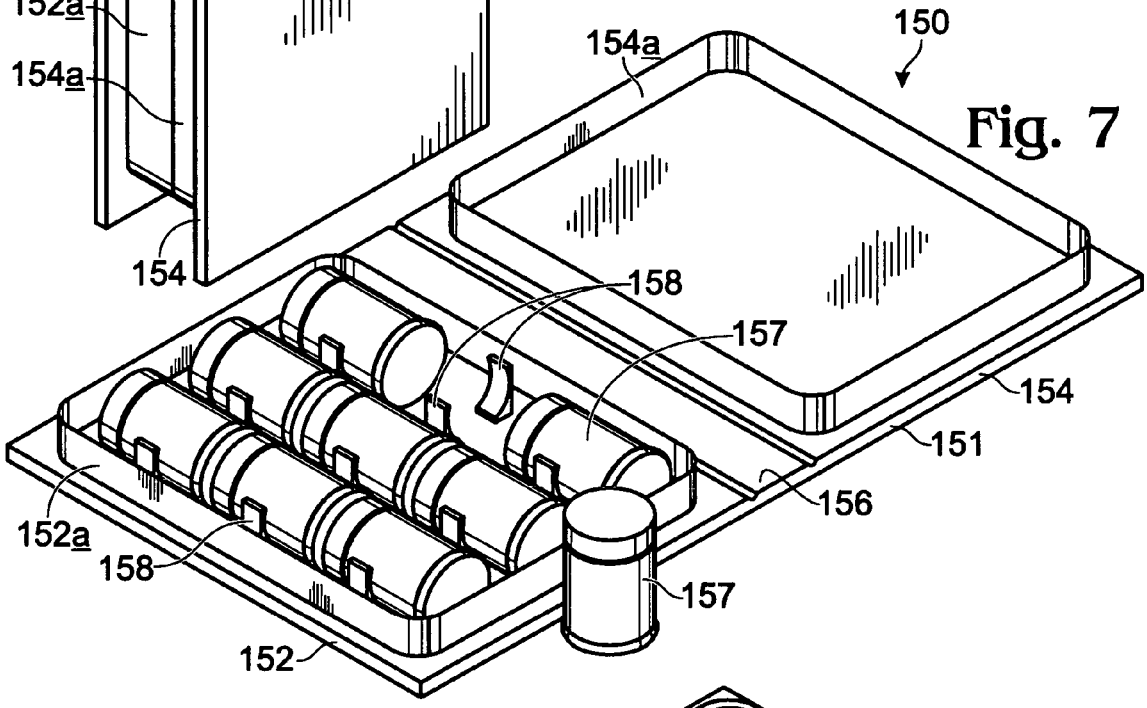
FIG. 7 is a perspective view of the case shown in FIG. 6, in an open configuration.

FIG. 7 shows kit 150 in an open configuration displaying the interior contents which consist primarily of spice containers 157. Spice containers 157 are retained in an organized arrangement inside front cover 152 and wall portion 152*a* by clips or holders 158. Holders 158 are dimensioned to clamp or grasp the sides of spice container 157 so that containers 157 can be easily engaged or "snapped" into place, and alternately removed for use. It will be appreciated that many different kinds of retention holders may be used to organize spice containers in a case such as the ones shown in FIGS. 6 and 7. For example, hook-or-loop fasteners may be used whereby a first hook-or-loop part is fastened to the inside of cover 152. A second part of a hook-or-loop fastener in the form of a belt or band may be secured around the circumference of a container. The container may then be simply attached and removed from the inside cover of the book-shaped case.

Figure 8:
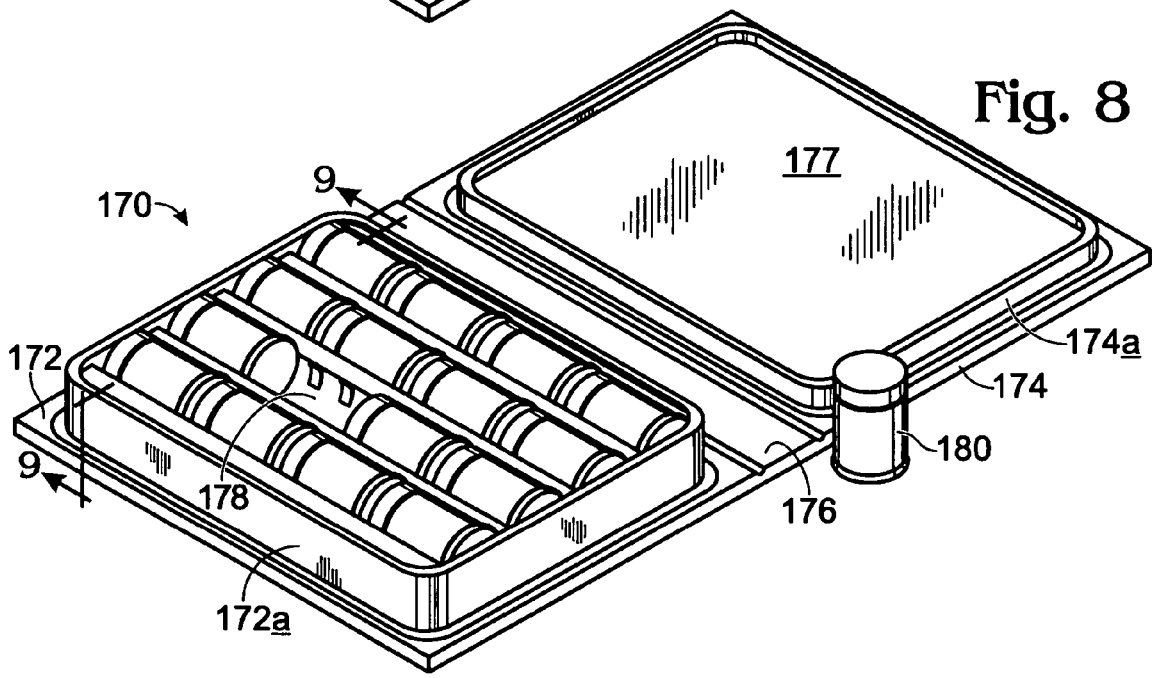
FIG. 8 is a perspective view of a modified book-shaped case for carrying spices, in an open configuration.

FIGS. 8 and 9 show another book-shaped kit for organizing and carrying spice containers. Kit 170 is similar to kit 150 in FIGS. 6 and 7. Kit 170 includes front cover 172 connected to back cover 174 through spine portion 176. Wall portions 172*a* and 174*a* are formed on the inner sides of front cover 172 and back cover 174 for containing the contents of the kit when it is closed. Compartment 177 is preferably a transparent pocket on the inner side of back cover 174 for containing recipe cards or other materials. A specially-molded interior 178 is provided on the inside of front cover 172 for retaining rows of spice containers 180. FIG. 9 shows a cross-section through front cover 172 and interior 178. Channels 182 are formed in interior 178. Each channel has a cylindrically-shaped wall that encompasses part of the circumference of spice container 180. One or more lip members 186 are formed along the channels to retain spice containers 180 in channel 182. Lip members 186 constrain channel 182 to encompass more than half but less than all of the circumference of container 180 so that spice containers can be easily "snapped" in and out of place in channel 182.

FIG. 10 shows a perspective view of portable kitchen kit 200 according to an alternative embodiment of this invention. Kit 200 includes case 202 in the form of an open top box including floor 204 and sidewalls 206*a-d* extending upward from floor 204. Case 202 also has lid 214 hingedly connected to sidewall 206*b*. Strap fastening member 216 or similar releasable means is provided to maintain case 202 in a closed condition for transport or storage.

The interior of case 202 is partitioned into a plurality of spaces by means of a partition matrix 218. Partition matrix 218 may be removably fitted into case 202 or permanently molded to the interior of the case. Partition matrix 218 may be formed by a plurality of partition plates. Each compartment 220 is sized to accommodate spice container 230. Compartment 220 may conform to fit a standard 2- or 4-oz. cylindrical spice container, or may accommodate a container of a different size. Container 230 generally includes a lid 232, visible from the top of open case 202. Lid 232 may be labeled so a user can readily identify the contents of container 230.

FIG. 11 shows another example of a portable kitchen kit 250. Kit 250 includes cylindrical case 252, with accompanying case lid 254 secured to the exterior of case 252 by restraining strap 256. Case 252 accommodates a plurality of shallow cylindrical containers 210 in a stacked configuration. Container 210 includes exterior wall 212 and lid 214, either of which may accommodate a label. Case 202 may be composed of any suitable rigid or flexible material. The material may be transparent so that the containers may be seen without opening the case. In this way, the user can determine the identity and quantity of the contents of each container without having to open the case or remove any containers.

Figure 12:
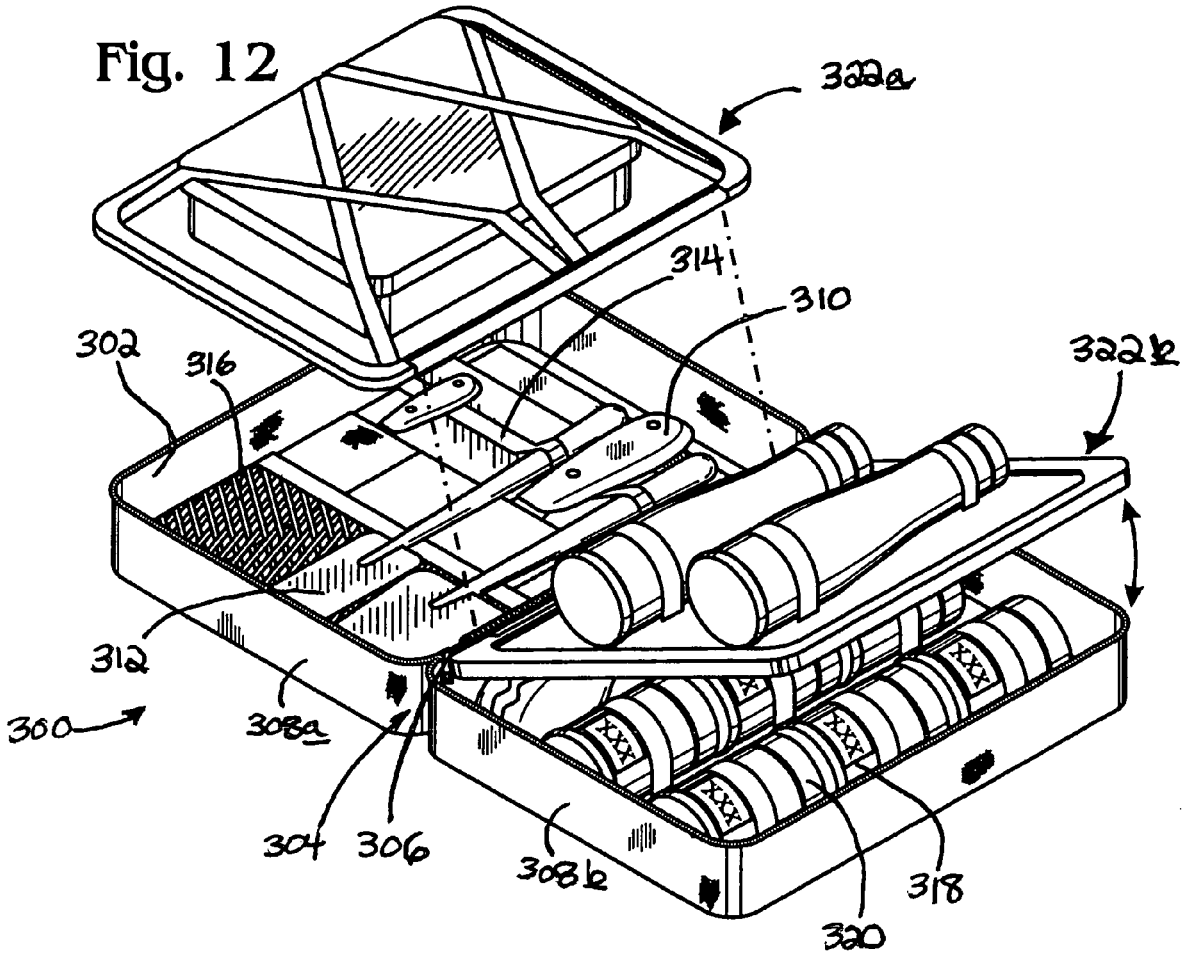
FIG. 12 is a perspective view of another portable kitchen kit having a book-shaped case and removable panel portions.

FIG. 12 shows another example of a portable kitchen kit 300. Kit 300 includes a carrying case 302 that has two substantially similar panel portions that are connected along a spine portion 304 of the case so that the case can be opened in a book-like manner to access the contents of the case. Spine portion 304 forms a hinge 306. Hinge 306 may be positioned to allow folding of case 302 substantially in half. As previously described, a zipper, snap, cloth or wire ties, or other fastening mechanism may be provided to maintain case 302 in a closed configuration for storage or transport.

FIG. 12 shows case 302 in an open configuration. Case 302 opens into two side panel portions or cupboard-like spaces, including first exterior panel portion 308*a* and second exterior panel portion 308*b*. As shown, numerous articles for cooking or preparing food, such as spices, sauces, spatulas, knives, and storage containers, may be contained in case 302. As used herein, food may include anything edible including, but not limited to meat, poultry, dairy products, fruits, vegetables, beverages of all types, spices and seasonings, etc. As shown, first exterior panel portion 308*a* holds kitchen utensils, such as one or more knives 310, more spatulas 312 and/or any other appropriate combination or selection of cooking utensils and/or containers for food preparation or transportation. Retention members, such as elastic straps 314 and/or pockets 316, may be used to hold the utensils or a variety of other food preparation items. Second exterior panel portion 308*b* may be configured to hold spice containers 318, as shown in FIG. 12, which may be secured by elastic restraints 320. Although exterior panel portions 308 may be used for storage of food preparation items, exterior panel portions 308 may merely form a protective covering for other contents. Exterior panel portions 306 may be substantially rigid so that case 302 may be set vertically on an end of the case on a table or counter. Additional hinges may be included to increase rigidity and/or storage capacity. For example, a second hinge may allow case 302 to be folded into thirds.

A variety of removable, and thereby interchangeable, interior panel portions 322 may be available to include in case 302 to increase storage and organizational capacity of case 302. As illustrated in FIG. 12, a first interior panel portion 322*a* and a second interior panel portion 322*b* may be coupled to spine portion 304 so that interior panel portions 322*a* and 322*b* may be rotated similarly to rotation of pages about the spine of a book. Interior panel portions 322 may include a variety of restraint devices such as hooks, straps, clips, elastic bands, and the like, as previously described, to hold food preparation items, such as storage containers, sauces, recipe cards, and additional utensils.

Figure 13:
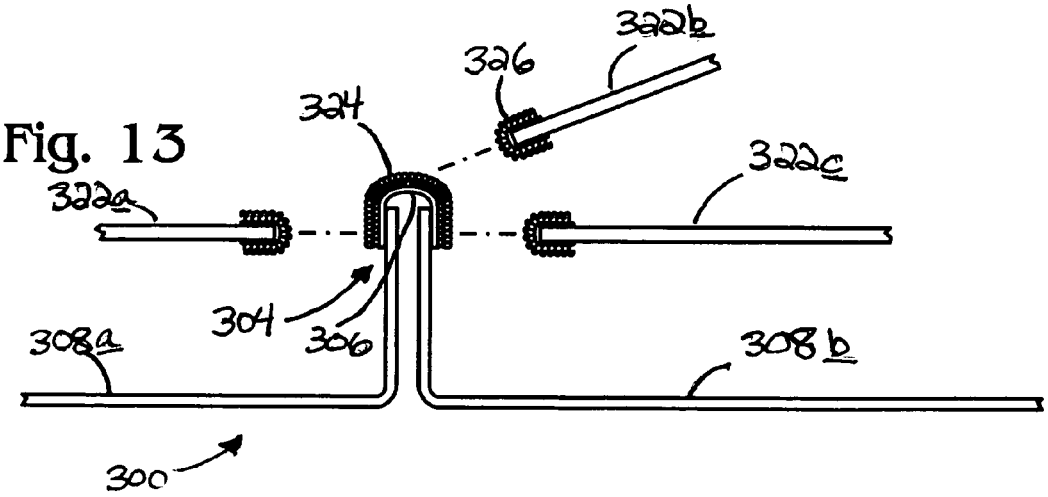
FIG. 13 is a cross-sectional view through the case shown in FIG. 12, illustrating coupling of the panel portions to the case.

Panel portions 322 may couple to case 302 using a variety of fasteners, including, but not limited to, snaps, hook-or-loop type materials, flexible or telescoping post and slot configurations, buttons, zippers, and the like. As shown in FIG. 13, spine portion 304 may include a piece of hook-or-loop type material 324 over hinge 306. Removable panel portions 322 may include a corresponding piece of hook-or-loop type material 326 along an edge to couple to spine portion 304. Panel portions 322*a*, 322*b*, and 322*c* are thereby configured to rotate about spine portion 304.

Panel portions 322 may be substantially rigid so that a user may quickly rotate through the panels, or panel portions 322 may be flexible so that the panels may be pressed together for more compact storing of differently shaped equipment and other contents. In the example of a single hinge, panel portions 322 may be substantially the same dimensions as half of the case. Panel portions 322 may be slightly smaller than sections of case 302 so that exterior panel portions 308 may completely surround the interior panels when the case is closed.

Removable interior panel portions 322 may be configured to couple to any of the previously described versions of kitchen kits. For example, panel portions 322 may couple to any region of case 102 (FIG. 5) and may be made of a flexible material so that one or more panel portions 322 may be rolled up within case 102.

Interior panel portions 322 may be customizable at the point of purchase or at any time a user desires a different configuration. For example, panel portions 322 may be configured to include the necessary food preparation items for a particular style of cooking, such as grilling, or for a particular type of food, such as Italian. The kit may also be customized for a specific event, or occasion, for example, a party, concert, sporting event, camping trip, etc. Kit 300 may be reconfigured to suit a user's particular needs for any given occasion by simply replacing an interior panel portion with another.

While the present invention has been particularly shown and described with reference to the foregoing preferred embodiments, those skilled in the art will understand that many variations may be made therein without departing from the spirit and scope of the invention as defined in the following claims. For example, the kits and systems described above may combine any number of different food preparation items including but not limited to tongs, whisk, wooden spoon, spatula, garlic press, wine opener, potato or carrot peeler, cheese grater, crab cracker, cherry pitter, meat thermometer, lemon or lime juicer, can opener, bottle opener, mini propane torch, zester, measuring cups, melon bailer, ice cream scoop, scrub brush, pot holder, mini cuisinart, sippy cups, liquor bottles, etc. Panels have retainers such as zip-lock pouches for containing pre-measured quantities of ingredients for particular dishes or recipes. For example, a given side of a detachable panel may be dedicated to carrying food items including, but not limited to, spices and a recipe card for a particular meal. In this way, the organization potential for the kit may greatly enhance ease of use during a trip or excursion. While it is often beneficial for auxiliary panels to be attached to an inner surface of the case as described above, panels may also be contained loosely or freely within the case. The description of the invention should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

I claim:

1. A portable kitchen kit comprising a book-shaped case having first and second panel portions hinged together along a spine portion so that the panel portions can be folded together to close the case, and alternately opened apart to access the interior of the case, a third panel portion detachably coupled to the case along an inner side of the spine portion so that the third panel portion is rotatable about the spine portion like a page in a book, retention devices on the panel portions holding a customized set of food containers and cooking utensils for food preparation or transportation, wherein the panel portions are reinforced sufficiently to maintain a substantially planar form, and a removable cutting surface contained in the case.

2. The kit of claim 1, wherein the inner side of the spine has a region of hook-or-loop material large enough to retain at least three page-like panels.

3. The kit of claim 2, wherein the third panel portion has a substantially continuous hook-or-loop region along an edge for connecting to the spine portion of the case.

4. The kit of claim 1, wherein the spine portion of the case has a ring-binder mechanism for retaining internal panel portions.

5. The kit of claim 1, wherein the third panel portion has retention devices on two sides.

6. The kit of claim 1, wherein at least some of the food containers contain spices.

7. The kit of claim 1, wherein the retention devices include an elastic band.

8. The kit of claim 1, wherein the retention devices include a pocket and a sheath insert for safely securing a knife inside the case.

9. The kit of claim 1, wherein a fastening mechanism is provided for holding the first and second panel portions together when the case is closed.

10. A portable kitchen kit comprising a case having first and second panel portions joined together along a hinge and rotatable between an open configuration in which the interior of the case is accessible and a closed configuration in which the interior of the case is not accessible, a third panel portion holding cooking utensils or food containers, wherein the third panel portion fits inside the case and is removably coupled to the case along the hinge, and further wherein at least two of the panel portions are substantially rigid, and a removable cutting surface contained in the case.

11. The kit of claim 10, wherein the third panel portion rotates about the hinge.

12. The kit of claim 10, wherein the third panel portion includes hook-or-loop material for removably coupling the third panel portion to the hinge.

13. The kit of claim 10 further comprising retention devices mounted to the third panel portion and adapted to retain equipment configured for preparing food.

14. The kit of claim 13, wherein the retention devices are removable.

* * * * *